US005290126A

United States Patent [19]

Gariepy et al.

[11] Patent Number: 5,290,126

[45] Date of Patent: Mar. 1, 1994

[54] ANTIROTATION DEVICE FOR SUBSEA WELLHEADS

[75] Inventors: James A. Gariepy, Cypress; Rodolfo Z. Lugo; B. Lee Danner, both of Houston, all of Tex.

[73] Assignee: ABB VectoGray Inc., Houston, Tex.

[21] Appl. No.: 807,543

[22] Filed: Dec. 13, 1991

[51] Int. Cl.[5] ..... E02D 5/74

[52] U.S. Cl. ..... 405/169; 405/223.1; 405/224; 166/349; 166/351

[58] Field of Search ..... 405/224.1, 169, 170, 405/195, 223.1; 285/330, 347, 23, 27; 166/341, 342, 349, 351

[56] References Cited

U.S. PATENT DOCUMENTS 2,517,391 8/1950 Ernestus ..... 285/27
3,220,245 11/1965 Van Winkle ..... 166/341 X
3,239,246 3/1966 Barber .
3,481,396 12/1969 Williams et al. ..... 166/341 X
3,702,707 11/1972 Rosan ..... 285/23
3,973,635 8/1976 Gatlin et al. ..... 166/349 X
4,293,146 10/1981 Beynet et al. ..... 285/347 X
4,907,914 3/1990 Gunderson et al. ..... 405/223.1 X

*Primary Examiner*—Dennis L. Taylor
*Attorney, Agent, or Firm*—James E. Bradley

[57] ABSTRACT

A subsea well assembly has an antirotation device to prevent rotation of an inner wellhead housing within an outer wellhead housing. A number of slots are formed in the upper rim of the outer wellhead housing. The slots have open upper ends. A number of pins are mounted to the exterior of the inner wellhead housing. Guide surfaces extend upward from the slots to guide the pins as the inner wellhead housing is lowered into the outer wellhead housing. The pins locate in the slots to prevent rotation.

16 Claims, 2 Drawing Sheets

ANTIROTATION DEVICE FOR SUBSEA WELLHEADS

BACKGROUND OF THE INVENTION

1. Field of the invention

This invention relates in general to subsea well drilling, and in particular to a means for preventing an inner wellhead housing secured to the lower end of a riser suspended from a drill ship from rotating within a conductor or outer wellhead housing.

2. Description of the Prior Art

Many subsea wells are drilled by first drilling a large diameter hole, then installing a string of conductor pipe, which has an outer wellhead housing secured to the upper end. Then, the operator drills the well to a greater depth and installs a first string of casing. An inner wellhead housing secures to the upper end of the string of casing and lands within the outer wellhead housing. The operator will then drill the well to a further depth. A string of riser will extend from the inner wellhead housing to the drilling vessel.

If a drill ship is being used as a drilling vessel, the drill ship will swing into the wind. This swinging movement can cause rotational forces on the riser. Normally, the rotation is resisted by frictional engagement of the landing shoulders of the inner wellhead housing and the outer wellhead housing. If the rotational force is high enough to cause the inner wellhead housing to begin to rotate within the outer wellhead housing, one of the casing joints below the inner wellhead housing could start to unscrew, causing a serious problem.

SUMMARY OF THE INVENTION

An antirotation device is provided to prevent an inner wellhead housing from rotating within an outer wellhead housing. The antirotation device includes providing a plurality of slots on the upper rim of the outer wellhead housing. The slots face upward. Preferably, each slot has guide surfaces that converge downward.

A plurality of pins extend radially outward from the inner wellhead housing. As the inner wellhead housing lands in the outer housing, unless the pins are precisely aligned with the slots, the pins will contact the guide surfaces. As the pins slide down the guide surfaces, the guide surfaces will cause the inner wellhead housing to rotate slightly, causing the pins to register with the slots. The pins enter the slots, preventing any further rotation of the inner wellhead housing in the outer wellhead housing.

DETAILED DESCRIPTION OF THE INVENTION

Figure 1:
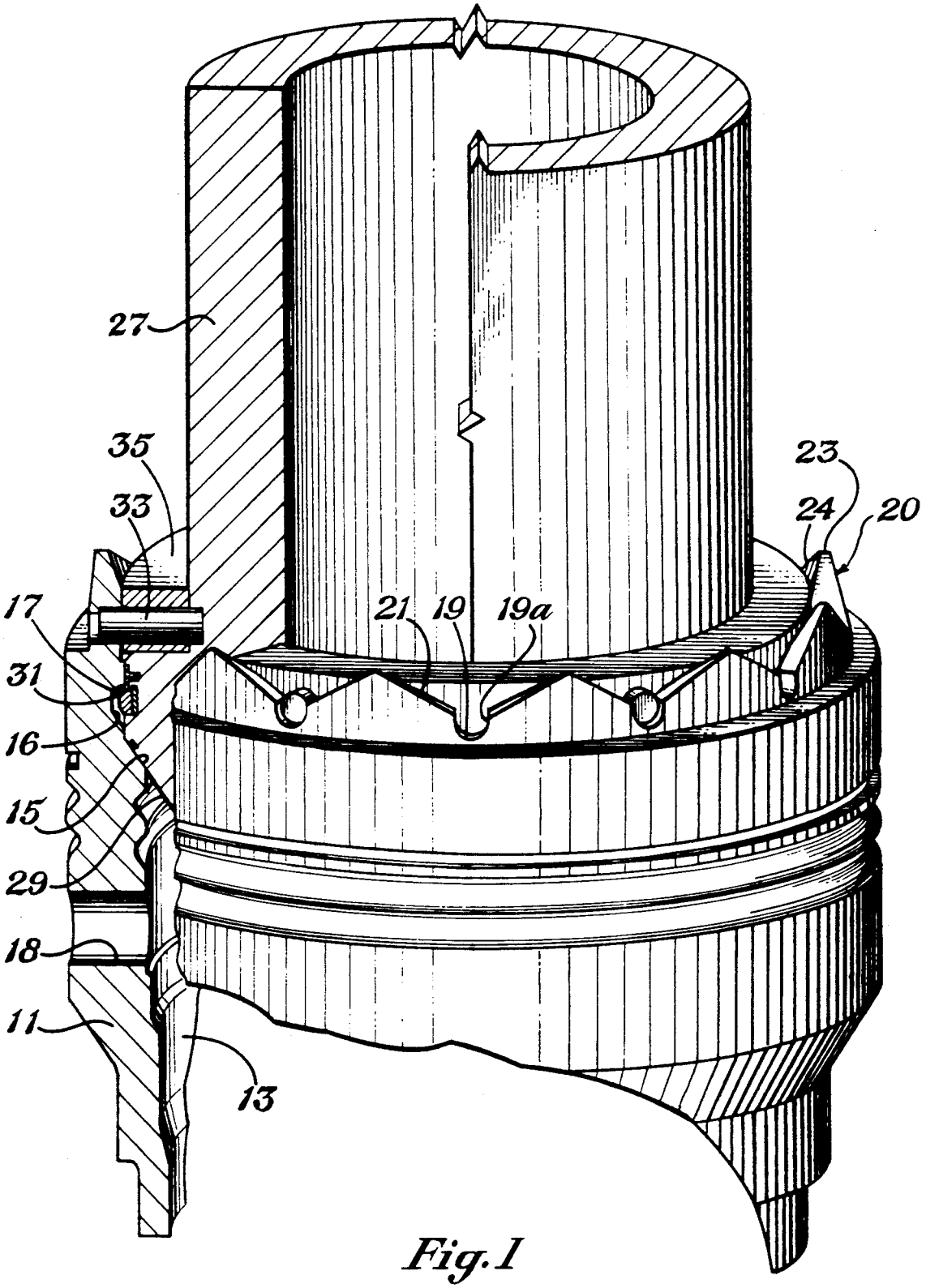
FIG. 1 is a perspective view, partially sectioned, illustrating an inner wellhead housing located in an outer wellhead housing, the inner and outer wellhead housings having an antirotation device to prevent rotation.
Figure 2:
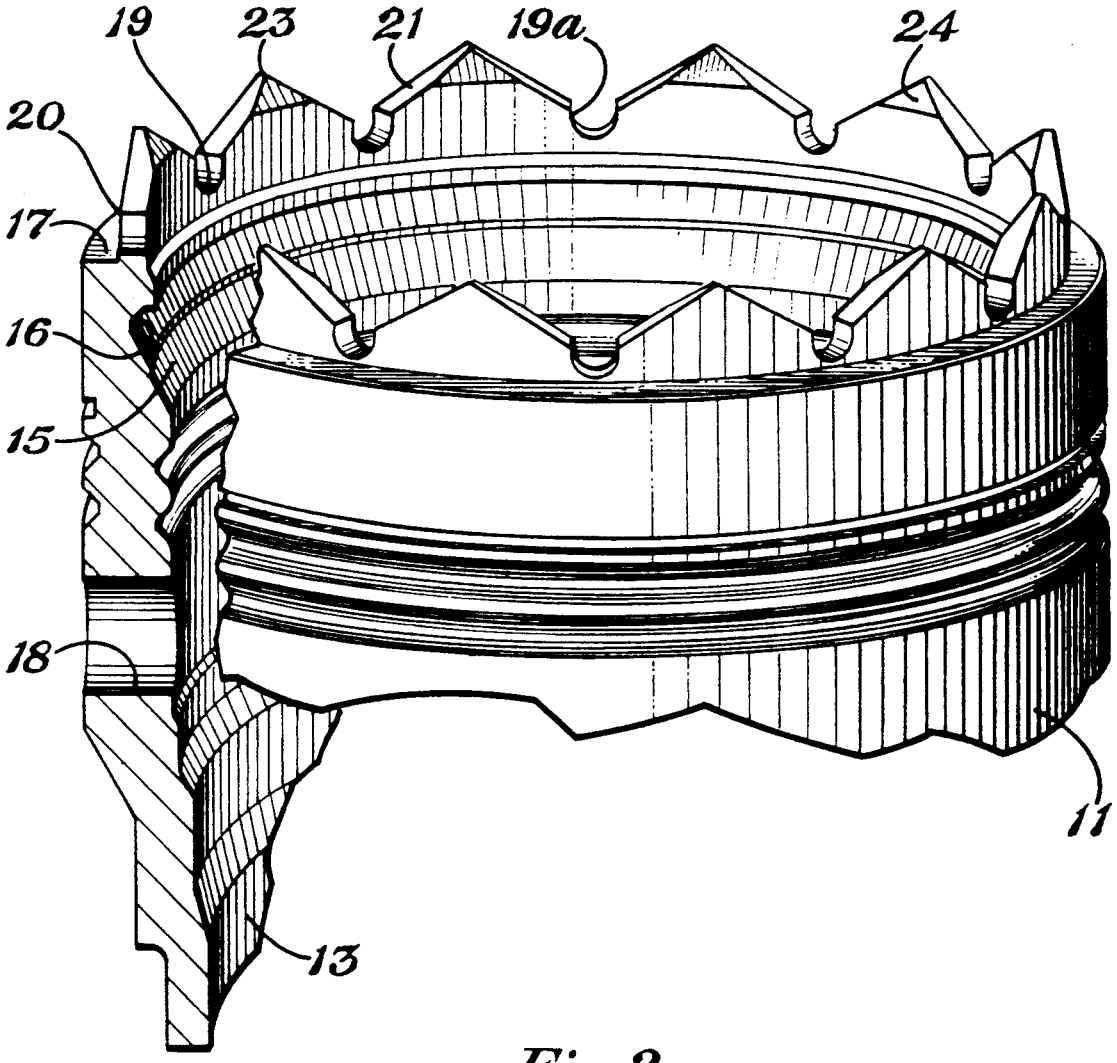
FIG. 2 is a perspective view, partially sectioned of the outer wellhead housing of FIG. 1.

Referring to FIG. 1, an outer wellhead housing 11 will be installed at the sea floor. Outer wellhead housing is a large tubular member secured to a string of conductor pipe (not shown). The conductor pipe extends into the well and will be cemented in place. Outer wellhead housing 11 has an axial bore 13. An internal, conical landing shoulder 15 locates in outer wellhead housing 11. A circular internal locking groove 16 is located above landing shoulder 15. Outer wellhead housing 11 has an upper rim 17 on its upper end. A plurality of ports 18 (only one shown) extend through the outer wellhead housing below landing shoulder 15.

Upper rim 17 includes a locking ring 20 extending upward therefrom. Locking ring 20 is shown integrally formed with outer wellhead housing 11. The wall thickness of locking ring 20 is less than the wall thickness of outer wellhead housing 11 at rim 17. The difference in wall thickness results in a portion of upper rim 17 being an upward facing shoulder located radially outward from locking ring 20.

Locking ring 20 has a plurality of slots 19 spaced apart from each other circumferentially around locking ring 20. Each slot 19 has a semi-circular lower portion, and two opposed sidewalls **19*a* extending upward from the lower portion. Sidewalls 19*a* are spaced circumferentially apart from each other and are substantially parallel with the axis of bore 13. Each slot 19 has a open upper end. The vertical extent of each slot 19 from the bottom to the open upper end is slightly more than the distance between sidewalls 19*a***.

A pair of guide surfaces 21 extend from each sidewall **19*a* upward at an inclination of about 30 degrees relative to horizontal, or 60 degrees relative to the axis of bore 13. Adjacent guide surfaces 21 form a pointed apex 23. This results in a generally triangular configuration of adjacent guide surfaces 21 between two slots 19. The pair of guide surfaces 21 for each slot 19 converge toward each other from the apexes 23 to the guide slots 19. Also, the inner wall of locking ring 20 has a bevel 24 that is conical. Each bevel 24 extends downward from an apex 23 to a point somewhat above the open upper end of each slot 19**.

An inner wellhead housing 27 will land in outer wellhead housing 11. The lower end of inner wellhead housing 27 secures to a string of casing (not shown) which extends into the well and is cemented in place. During cementing, returns will flow out port 18. The upper end of inner wellhead housing 27 will connect to a string of riser (not shown) which extends upward to a drill ship. Inner wellhead housing 27 has an external downward facing conical landing shoulder 29. Landing shoulder 29 mates with and is supported on internal landing shoulder 15. A plurality of spring biased latches 31 (only one shown) on inner wellhead housing 27 snap outward to engage groove 16 to retain inner wellhead housing 27 in outer wellhead housing 11.

A plurality of pins 33 extend radially outward from the exterior of inner wellhead housing 27. Pins 33 are rigid, cylindrical members, preferably pressed into a mounting ring 35. Ring 35 rigidly mounts to inner wellhead housing 27. Pins 33 are spaced apart for engaging the slots 19. In the embodiment shown, there are twice as many slots 19 as pins 33. The diameter of each pin 33 is only slightly less than the distance between the slot walls **19*a*. A portion of each pin 33 will protrude slightly above the open upper end of each slot 19. This portion is less than one half of the diameter of each pin 33**.

The distance from inner wellhead housing landing shoulder 29 to each pin 33 is slightly greater than the distance from outer wellhead housing landing shoulder 15 to the bottom of each slot 19 When inner wellhead housing 27 is installed in outer wellhead housing 11, a slight clearance will exist between the bottoms of pins 33 and the bottoms of slots 19. This clearance assures that downward load on inner wellhead housing 27 passes through the landing shoulders 15, 29, and not through any of the pins 33 to the bottom of slots 19.

In operation, the operator will install the outer wellhead housing 11 conventionally. The operator will secure the inner wellhead housing 27 to a string of riser and lower the inner wellhead housing 27 into the sea. Casing (not shown) secured to the inner wellhead housing 27 will extend into the well through bore 13.

Normally, the pins 33 will contact some portion of the guide surfaces 21 as it would be unlikely that the pins 33 would be initially aligned with the slots 19. Guide surfaces 21 will cause the inner wellhead housing 27 to rotate in one direction or the other a slight amount until each of the pins 33 registers with one of the slots 19. The inner wellhead housing 27 will then drop into place, with each pin 33 locating in one of the slots 19.

Latches 31 will spring out and snap into groove 16 to prevent upward movement of inner wellhead housing 27. The casing secured to inner wellhead housing 27 will be cemented. Further drilling may then take place. Any rotational force on the riser and on inner wellhead housing 27 will be resisted by the contact of pins 33 with the sidewalls 19*a* of slots 19.

The invention has significant advantages. The antirotation device prevents rotation of the inner wellhead housing relative to the outer wellhead housing. The device is simple and rugged. The guide surfaces automatically align the pins with slots.

While the invention has been shown in only one of its forms, it should be apparent to those skilled in the art that it is not so limited, but is susceptible to various changes without departing from the scope of the invention.

We claim:

1. In a subsea well assembly having an outer wellhead housing located at a sea floor, the subsea well assembly having an inner wellhead housing which lands in the outer wellhead housing, the inner wellhead housing having a lower end secured to a string of casing and an upper end secured to a spring of conduit, the inner wellhead housing being lowered on the string of conduit from a drilling vessel into the outer wellhead housing, an improved antirotation means for preventing rotation of the inner wellhead housing in the outer wellhead hosing due to swinging movement of the drilling vessel, comprising in combination:

at least one slot formed in the outer wellhead housing, the slot having opposed sidewalls which are circumferentially spaced apart from each other; and at least one pin secured to the inner wellhead housing, the pin being received in the slot when the inner wellhead housing lands in the outer wellhead housing at the sea floor, the sidewalls of the slot engaging the pin to prevent all rotation of the inner wellhead housing in the outer wellhead housing once the inner wellhead housing lands in the outer wellhead housing.

2. The antirotation means according to claim 1 wherein the inner wellhead housing has an axis, wherein the pin protrudes radially from the inner wellhead housing, and wherein the slot has a lower portion that receives a portion of the pin when the inner wellhead housing lands in the outer wellhead housing and has a circumferential width that is substantially equal to a diameter of the portion of the pin that engages the slot.

3. The antirotation means according to claim 1 wherein the inner wellhead housing has an axis, a rim, and a lock ring protruding upward from the rim, wherein the pin is rigidly mounted to the inner wellhead housing and protrudes radially therefrom, and wherein the slot is located in and extends through the lock ring from an inner side of the lock ring to an outer side of the lock ring.

4. The antirotation means according to claim 1 wherein the outer wellhead housing has a lock ring protruding upward from a rim of the outer wellhead housing, and wherein the slot is located in the lock ring.

5. A subsea well assembly, comprising in combination:

an outer wellhead housing located at a sea floor, the outer wellhead housing having an axis and an axial bore containing an internal landing shoulder, the outer wellhead housing having a circular rim on its upper end;

a lock ring protruding upward from the rim;

a plurality of slots formed in and spaced apart from each other around the lock ring, each of the slots having an open upper end at an upper edge of the lock ring;

an inner wellhead housing located in the outer wellhead housing, the inner wellhead housing having an external landing shoulder which engages the internal landing shoulder as the inner wellhead housing is lowered into the outer wellhead housing on a string of conduit from a drilling vessel; and a plurality of pins secured to the inner wellhead housing, each of the pins being received in one of the slots to prevent rotation of the inner wellhead housing in the outer wellhead housing.

6. The subsea well according to claim 5 wherein each of the pins extends radially from the inner wellhead housing, an each of the slots extend through the lock ring from an inner side of the lock ring to an outer side of the lock ring.

7. The subsea well according to claim 5 wherein each of the pins extends rigidly and radially from the inner wellhead housing and wherein the slot has a lower portion that receives a portion of the pin when the inner wellhead housing lands in the outer wellhead housing and has a circumferential width that is substantially equal to a diameter of the portion of the pin that engages the slot.

8. The subsea well according to claim 5 further comprising at least one guide surface at the upper edge of the lock ring and inclining downward into each of the slots relative to the axis of the outer wellhead housing to guide the pins into the slots.

9. The subsea well according to claim 5 further comprising a pair of guide surfaces at the upper edge of the lock ring and extending downward and converging inward into each of the slots, the guide surfaces between each of the slots intersecting each other in a triangular apex to guide the pins into the slots.

10. The subsea well according to claim 5 wherein:

each of the slots has a bottom; and wherein a clearance exists between a lower side of each of the pins and the bottom of each of the slots to assure that downward forces imposed on the inner wellhead housing will transmit through the landing shoulders to the outer wellhead housing, rather than from the pins to the bottoms of the slots.

11. In a subsea well assembly having an outer wellhead housing located at a sea floor and having an axial bore, the subsea well assembly having an inner wellhead housing which is lowered from a drilling vessel on a string of conduit into and lands in the bore of the outer wellhead housing, the inner wellhead housing having a lower end secured to a string of casing, an improved antirotation means for preventing rotation of the inner wellhead housing in the outer wellhead housing due to swinging movement of the drilling vessel, comprising in combination:

a plurality of slots formed in and spaced apart from each other around the rim, each of the slots having an open upper end and opposed sidewalls, at least a portion of each sidewall extending axially;

a pair of guide surfaces extending downward and converging toward each other into each of the slots, the guide surfaces between each of the slots intersecting each other in a triangular apex; and a plurality of pins rigidly secured to the inner wellhead housing and protruding radially therefrom, each of the pins being received in one of the slots to prevent rotation of the inner wellhead housing in the outer wellhead housing.

12. An improved method for preventing rotation of an inner wellhead housing in an outer wellhead housing due to swinging movement of a drilling vessel, the outer wellhead housing being located at a sea floor and having an axial bore and an internal landing shoulder, the inner wellhead housing being secured to a string of conduit toward from the drilling vessel for reception int he outer wellhead housing and having an external landing shoulder, the method comprising:

providing at least one slot in the outer wellhead housing with opposed sidewalls which are circumferentially spaced apart from each other;

securing at least one pin to the inner wellhead housing; then lowering the inner wellhead housing from the drilling vessel on the string of conduit into the outer wellhead housing, causing the inner wellhead housing to rotate a limited amount if necessary until the pin registers with the slot, then locating the pin in the slot, and causing the external landing should to engage the internal landing shoulder, the circumferential spacing of the sidewalls of the slot restraining the inner wellhead housing from all rotation relative to the outer wellhead housing.

13. The method according to claim 12 wherein the step of providing the slot further comprises providing the slot with an open upper end and a bottom, and spacing the sidewalls of the slot apart at the bottom a distance substantially equal to a diameter of the portion of the pin that engages the slot.

14. The method according to claim 12 wherein:

the step of providing the slot further comprises providing the slot with an open upper end and a bottom, and spacing the sidewalls of the slot apart at the bottom a distance substantially equal to a diameter of the portion of the pin that engages the slot; and wherein the step of securing the pin comprises securing the pin rigidly in a portion wherein the pin extends radially from the inner wellhead housing for reception in the open upper end of the slot as the inner wellhead housing moves downward in the outer wellhead housing.

15. The method according to claim 12 wherein:

the step of providing the slot further comprises providing the slot with an open upper end and downward converging guide surfaces; and wherein the step of securing the pin comprises securing the pin rigidly in a portion wherein the pin extends radially from the inner wellhead housing for contact with the guide surfaces and reception in the open upper end of the sllot as the inner wellhead housing moves downward in the outer wellhead housing.

16. An improved method for mounting an inner wellhead housing in an axial bore of an outer wellhead housing of a subsea well, comprising:

providing the outer wellhead housing with an upper rim, a lock ring protruding upward from the rim, the lock ring having a plurality of slots spaced circumferentially around the rim, each slot having an open upper end;

providing each of the slots with at least one guide surface inclining downward into the open upper end of each slot;

rigidly securing a plurality of pins to the inner wellhead housing, and spacing the pins circumferentially apart from each other and protruding radially from the inner wellhead housing; then lowering the inner wellhead housing from a drilling vessel on a string of conduit into the outer wellhead housing until the pins contact the guide surfaces, the guide surfaces causing the inner wellhead housing to rotate a limited amount if necessary until each of the pins registers with one of the slots, then lowering the inner wellhead housing further until each of the pins locates in one of the slots to prevent rotation of the inner wellhead housing in the outer wellhead housing due the swinging movement of the drilling vessel.

* * * * *

UNITED STATES PATENT AND TRADEMARK OFFICE

CERTIFICATE OF CORRECTION

PATENT NO. : 5,290,126

DATED : March 1, 1994

INVENTOR(S) : James Gariepy, et al.

It is certified that error appears in the above-indentified patent and that said Letters Patent is hereby corrected as shown below:

At column 2, line 68, "19" should be --19.--;
At column 4, line 39, "an" should be --and--;
At column 4, line 39, "extend" should be --extends--;
At column 5, line 31-32, "int he" should be --in the--;
At column 5, line 45, "should" should be --shoulder--.

Signed and Sealed this

Twenty-ninth Day of November, 1994

Bruce Lehman

*Attest:*

BRUCE LEHMAN

*Attesting Officer*

*Commissioner of Patents and Trademarks*